US005413466A

United States Patent [19]

Bennett et al.

[11] Patent Number: 5,413,466

[45] Date of Patent: May 9, 1995

[54] UNIFIED FUEL PUMP ASSEMBLY

[75] Inventors: George L. Bennett, Hebron; Jack G. Sundberg, Meriden, both of Conn.

[73] Assignee: Coltec Industries Inc., New York, N.Y.

[21] Appl. No.: 142,274

[22] Filed: Oct. 25, 1993

[51] Int. Cl.[6] ..... F04C 19/00; F04R 23/14

[52] U.S. Cl. ..... 417/69; 417/203; 417/205; 417/350

[58] Field of Search ..... 417/69, 201, 203, 205, 417/350

[56] References Cited

U.S. PATENT DOCUMENTS

| | | | |
|---|---|---|---|
| 2,134,686 | 11/1938 | De Lancey | 417/201 |
| 3,026,810 | 3/1962 | Kubiak et al. | 417/203 |
| 3,107,626 | 10/1963 | Thoren et al. | 417/69 |
| 3,141,416 | 7/1964 | Bolan et al. | 417/350 X |
| 3,518,028 | 6/1970 | Minick | 417/69 |
| 5,061,151 | 10/1991 | Steiger | 417/69 X |
| 5,078,573 | 1/1992 | Peroaho et al. | 417/69 X |

*Primary Examiner*—Richard E. Gluck
*Attorney, Agent, or Firm*—Howard S. Reiter

[57] ABSTRACT

A unified fuel pump assembly combines a vane-type pump and a booster stage for the inlet of the vane-type pump, in a unitary structure to substantially reduce "windage" losses caused by relatively moving parts. The unified structure also includes an electric motor subassembly to provide motive power, and a liquid ring pump, which helps to process air bubbles through the fuel pump, is coupled to the electric motor rotor to further avoid "windage" losses. The vane type pump relies on the use of a central shaft capable of having a substantially uniform and relatively large diameter from end to end.

9 Claims, 2 Drawing Sheets

UNIFIED FUEL PUMP ASSEMBLY

BACKGROUND OF THE INVENTION

This invention relates generally to fuel pumps for combustion engines and more specifically relates to fuel pump assemblies having a vane type pump for supplying fuel to an engine in combination with a dynamic booster pump for delivering fuel from a supply source such as a fuel tank, to the inlet of the vane pump.

Rotary vane type fuel pumps are well known in the aircraft engine art. In the past, design considerations and limitations have required such pumps to include axial shafts having journal ends of relatively small diameter. In this context, the term relatively small refers generally to the diameter of the journal ends of the shaft which are supported by rotary bearings, relative to the central rotor portion of the shaft. For example in vane pumps of known design, if the diameter of the rotor portion was specified as D, it would be necessary, in general, to limit the diameter of the journal end to not more than $D-2\times$ (depth of the vane slot $+0.1$). The term journal end refers to the portion of the rotary shaft that is supported by rotary bearings; it will be understood in this regard that such portion of the shaft need not necessarily be located at the extreme end of the shaft.

In co-pending U.S. patent application Ser. No. 08/114,253, filed Aug. 30, 1993, and assigned to the same entity as this application, there is disclosed a new type of variable displacement vane pump in which the diameter of the rotary shaft is made significantly greater than it was in vane pumps of the prior art and which can be substantially uniform in diameter from end to end. Specifically, in the new type of vane pump there disclosed, it is possible for the bearing support portions of the shaft, i.e. the journal ends, to be of substantially the same diameter as the main, vane-supporting portion of the shaft. The present invention relates to this new type of vane pump and the specification of the co-pending application is, accordingly, referred to expressly and incorporated by reference herein.

Limitations inherent in the design of some aircraft, result in the delivery of fuel at relatively low pressure to the inlet of the vane pump or vane pumps that are used as the main source of fuel pressure for the aircraft engines. To meet the requirements for high output pressure to supply the engines, while overcoming the limitations of low inlet pressure coming form the fuel supply reservoir, the practice of using inlet pressure booster pumps has been developed.

In the past, the main engine vane pumps and the booster pumps used to supply the vane pump inlets have been separate and distinct devices. A significant disadvantage of using main engine pumps and booster pumps that are separate and distinct from one another is the resulting substantial increase in "windage" energy losses and the corresponding decrease in pump efficiency. In this regard, "windage" refers to the energy losses incurred when a rotating or other moving surface, such as the surface of the rotary impeller in a booster pump, is constrained to move in close proximity to a stationary surface such as the inner surface of the housing for such a pump. "Windage" losses also include the energy dissipated in the separate sets of rotary bearings used in both the vane pump and the booster pump.

It is desirable, in general, to reduce windage losses so as to increase pump efficiency.

It is desirable, also, to reduce the total space/volume occupied by equipment such as fuel pumps and related components, in the engine area of an aircraft.

Accordingly, it is an object of the present invention to provide a unified engine fuel pump assembly, combining the functions of both a vane pump and a booster pump, to achieve increased energy efficiency.

It is another object of the present invention to provide a unified engine fuel pump assembly having reduced windage losses.

It is still another object of the present invention to provide such a fuel pump assembly having a reduced number of parts.

A further object of this invention is the provision of a unique engine fuel pump assembly having a larger diameter rotary shaft than in prior art vane pumps and a booster pump impeller diameter that is smaller than in prior art devices, and is not substantially larger than the diameter of said rotary shaft, to reduce the overall space/volume requirements of the assembly.

These and other and further objects, features and advantages of this invention will be made apparent to those having skill in this art by reference to the following specification and the accompanying drawings, in which:

DETAILED DESCRIPTION OF THE INVENTION

Figure 1:
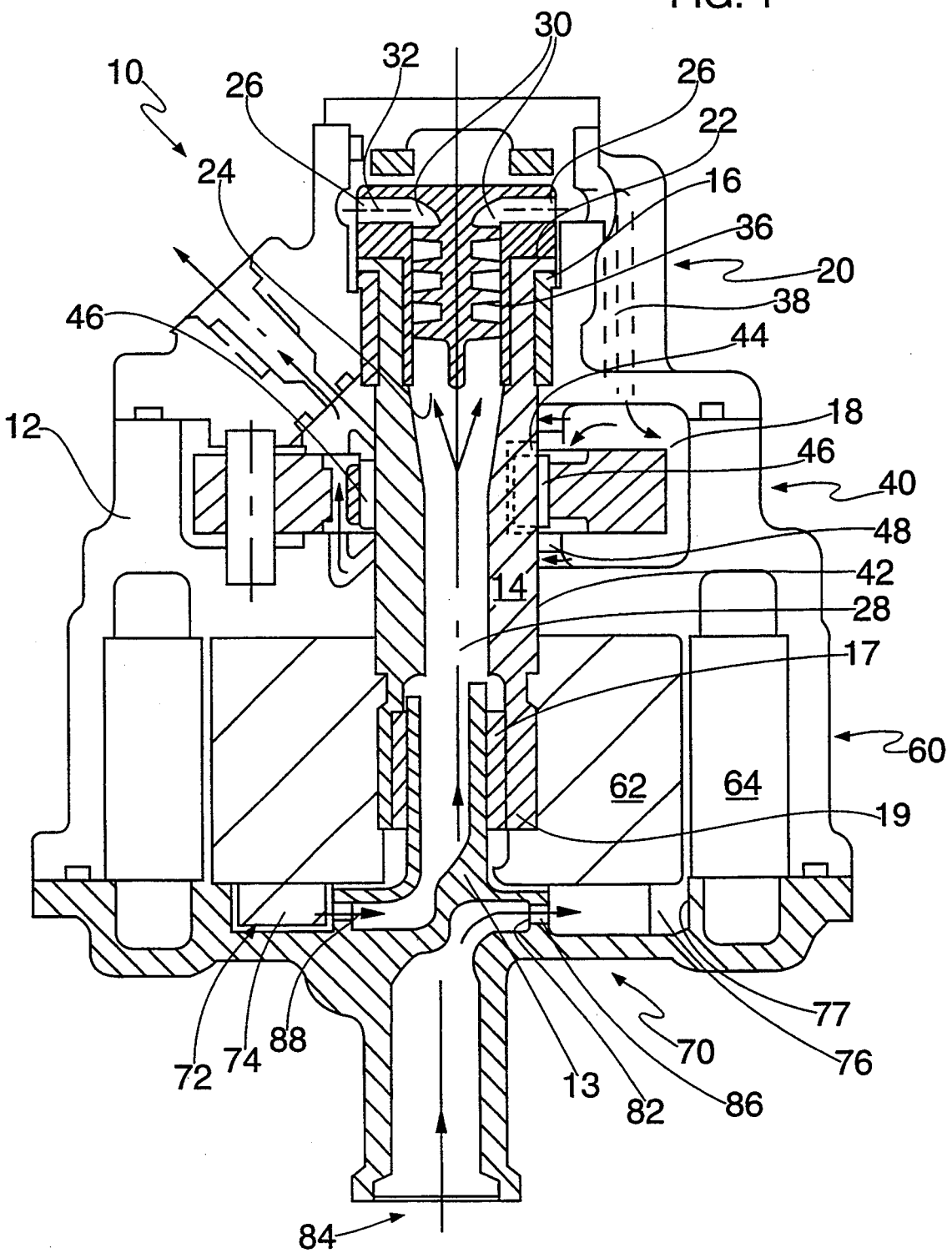
FIG. 1 is a side sectional view of one embodiment of a unified fuel pump assembly in accordance with this invention.

Referring now to the drawings, the embodiment disclosed in FIG. 1 may be seen to represent a unified fuel pump assembly 10 comprising a housing 12 incorporating a booster pump subassembly 20, a vane pump subassembly 40, an electric drive motor subassembly 60 and a liquid ring pump subassembly 70.

Figure 2:
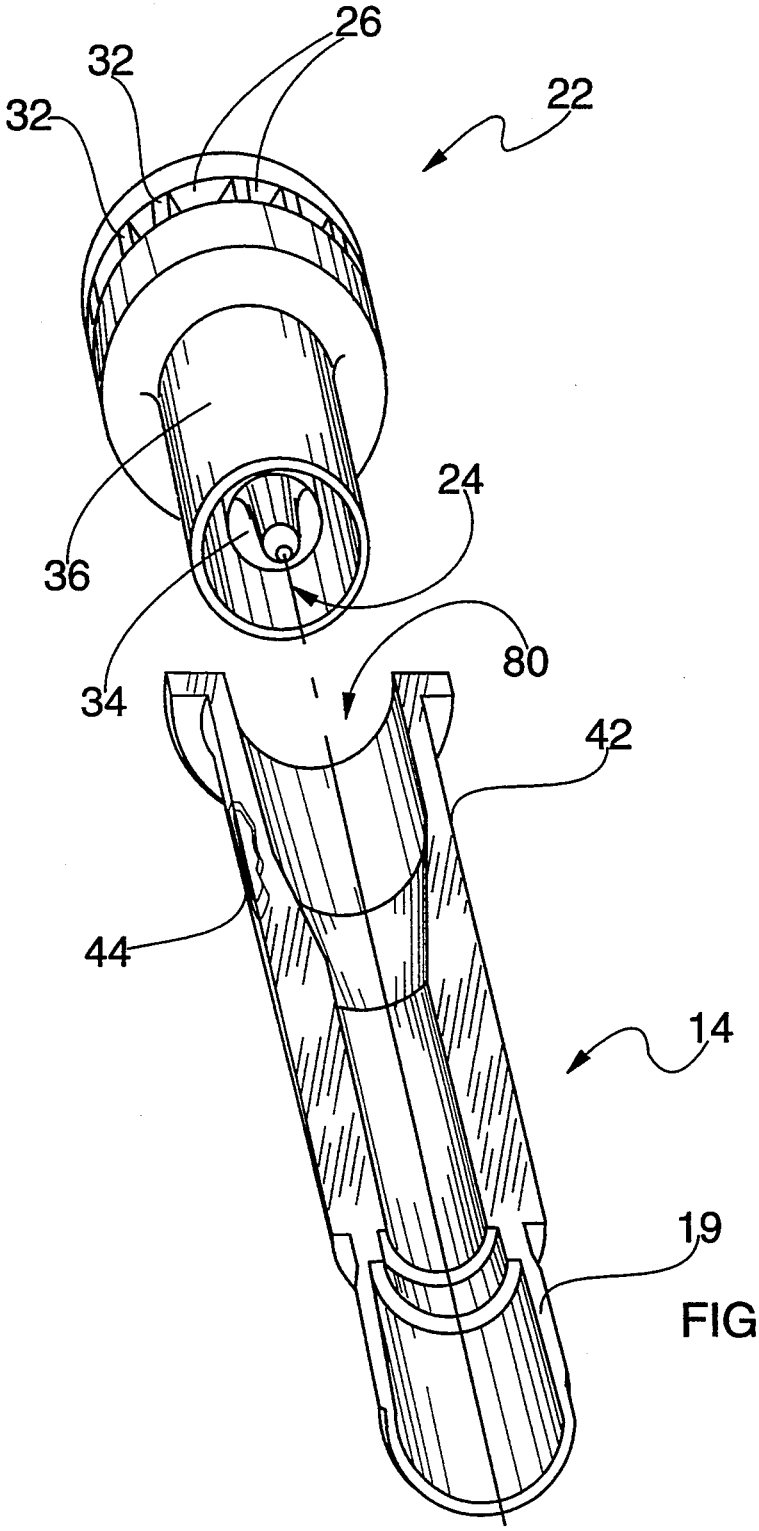
FIG. 2 is a pictorial representation of a booster pump impeller and mating vane pump inlet/shaft used in the embodiment of FIG. 1.

An axially extending shaft 14, is supported for rotation within housing 12 by axially spaced-apart rotary bearings 16 and 17. Shaft 14 is illustrated separately in FIG. 2 of the drawings, for purposes of clarity and explanation.

Shaft 14 is provided with an axial portion 42 of given diameter having a plurality of peripherally spaced-apart slots 44 for supporting radially extending pumping vanes 46. The relationship and design requirements among shaft 14, slots 44 and vanes 46, which together define a significant part of vane pump subassembly 40; are more completely disclosed and explained in copending U.S. patent application Ser. No. 08/114,253 filed Aug. 30, 1993, which has been incorporated herein by reference.

Rotation of shaft 14 within housing 10 on bearings 16 and 17, rotates vanes 46 within a pumping chamber 18 formed within housing 10 in accordance with the disclosure in the identified co-pending application.

Booster pump subassembly 20 operates in a conventional manner well known to those having skill in this art. More specifically, an impeller member 22 of generally cylindrical structure includes at least one inlet opening 24 and at least one outlet opening 26, with at least one but preferably a plurality of interior fluid conduits 30 connecting the inlet to the outlet. As the impeller member is rotated in a manner which will be made apparent, fluid drawn into the inlet 24 of impeller 22 is accelerated in a radially outward direction through conduits 30 under the influence of centrifugal force; acceleration in this manner increases both the static pressure and the velocity of the fluid that is released from the impeller through the discharge openings.

The housing 12 of the unified assembly 10 is provided with internal fluid passages or passways 38 to guide pumped fluid from discharge openings 26 to the root area 48 of pumping vanes 46, adjacent to the outer surface of axial portion 42 of shaft 14.

In the disclosed embodiment, impeller member 22 of booster pump subassembly 20 is shown to be a standard form of radial blade dynamic impeller having a plurality of radially extending radial blades 32 that are connected in a well known manner to a screw-type inlet inducer 34. Although this particular type of impeller is illustrated in use in the booster stage subassembly 20, it should be understood that other types of dynamic impellers may be used.

In the disclosed unified fuel pump assembly, the rotating shaft 14 is shown coupled to an electric motor subassembly 60 which provides motive power for rotating the shaft 14 together with the vanes 46 of vane pump subassembly 40 and the impeller member 22 of booster pump subassembly 20. Electric motor 60 may be seen to comprise a rotor member 62, coupled directly to the journal of shaft 14 and a stator member 64, both being of any suitable well known design. In this embodiment of the invention, fluid to be pumped is delivered to the inlet opening 24 of impeller 22 by means of an axial inlet passage 28 extending through the length of shaft 14. As shown clearly in FIG. 2, impeller 22 is provided with a cylindrical axially extending portion 36 that is dimensioned to mate in force fitting relationship with a corresponding receptacle opening 80 in one end of shaft 14. Although shaft 14 and impeller 22 which thus forms an axial extension from one end of the shaft, are shown to comprise a two-piece assembly in this embodiment, it should be understood that other, substantially equivalent one-piece structures may be used for the purposes herein disclosed.

It can be seen in FIG. 1 of the drawings, that the end portion 19 of shaft 14, is supported for rotation relative to the housing 12, by rotary bearing 17. It is intended to be clear, also, that rotary bearing 17 is supported in substantially fixed relationship relative to housing 12, by means of support member 13. It can be seen that support member 13 includes a through opening 82 through which inlet fluid is guided from inlet port 84 into axial passage 28 in shaft 14, and ultimately into inlet 24 of impeller 22. Through opening 82 includes an inlet port 84 which guides inlet fluid from inlet port 84 into the liquid ring subassembly 70.

Liquid ring assemblies are well known in the prior art as a means for eliminating accumulation of air bubbles in fluid pumping systems. The disclosed liquid ring subassembly comprises a paddle-like impeller 72 having a plurality of paddle elements 74 extending radially relative to, and rotating with, shaft 14 in eccentric, off-center rotating relationship to a cylindrical ring chamber 76. In this preferred embodiment, paddle elements 74 are shown mounted directly to electric motor rotor 62, to avoid unnecessary additional "windage" losses which would be incurred if a separate ring pump device was employed. It should be understood, however, that the paddle-like impeller 72 could be coupled directly to shaft 14 or to another rotating element, if it is desired to incorporate the features of this invention into an embodiment which does not include an electric motor subassembly as illustrated here.

As the paddle-like impeller 72 rotates within ring chamber 76, fluid, which is heavier than any entrapped air bubbles, is displaced to the outer-most limits of chamber 76 by centrifugal force, while any air that is present becomes trapped within the outer ring of fluid. An outlet opening 88 from ring chamber 76 is shown in FIG. 1; it is positioned at or close to the point in the chamber where the distance between the outer wall 77 and the axis of rotation of paddles 74 is least, so that air trapped between the outer ring of fluid and the central axis of shaft 14 will be forced out of ring chamber 76 through opening 88 and into axial passage 28.

A unified fuel pump assembly incorporating both a liquid ring subassembly 70 and an electric motor 60 have been disclosed herein as one form of this invention. It should be recognized readily, however, that other forms of this invention may incorporate other means of supplying rotational power to shaft 14, and other means of dealing with entrapped air balloons.

A specific embodiment of this invention now having been disclosed and explained, the following claims are intended to particularly point out and distinctly identify the subject matter of the invention.

We claim:

1. A unified fuel pump assembly of the type used aboard aircraft, comprising:

a housing;

a pair of spaced-apart rotary bearings mounted to said housing;

an axially extending shaft, having an axial portion of given diameter, said shaft being supported by said bearings for rotation relative to said housing;

a vane pump subassembly having a plurality of radially displaceably pumping vanes extending radially from said given diameter axial portion of said shaft in peripherally spaced-apart relationship;

each of said radially displaceable pumping vanes having a root area adjacent to the said axial portion of said shaft;

a boost pump subassembly, having a dynamic impeller axially supported by said shaft for rotation therewith, coupled to said shaft in axially spaced relationship to said vane pump subassembly;

said dynamic impeller having an inlet passage for receiving fluid to be pumped, and a plurality of outlet passages defining a diameter of said impeller not substantially greater than the said given diameter portion of said shaft; and fluid passage means in said housing for guiding pumped fluid from said outlet passages of said impeller to the root areas of said pumping vanes adjacent to the given diameter axial portion of said shaft.

2. A unified fuel pump assembly of the type used aboard aircraft, comprising:

a housing;

a pair of spaced-apart bearings supported by said housing;

an axially extending shaft, having an axial portion of given diameter, supported by said bearings for rotation relative to said housing;

a vane pump subassembly having a plurality of radially displaceable pumping vanes extending radially from a portion of said shaft having a diameter not substantially greater than said shaft in peripherally spaced-apart relationship;

each of said radially displaceable pumping vanes having a root area adjacent to the said axial portion of said shaft;

a booster pump subassembly having a dynamic impeller axially supported by said shaft for rotation therewith in axially spaced relationship to said vane pump subassembly;

said dynamic impeller having an inlet passage for receiving fluid to be pumped, and a plurality of outlet passages defining a diameter of said impeller for discharging pumped fluid from said impeller; and said housing having fluid passage means for guiding pumped fluid from said outlet passages of said impeller to the root areas of said pumping vanes.

3. A unified fuel pump assembly in accordance with claim 2, wherein:

said shaft further includes an axial opening extending from one end thereof to the other end thereof for providing fluid access to the said inlet passage of said dynamic impeller.

4. A unified fuel pump assembly in accordance with claim 3, wherein:

said dynamic impeller includes a substantially cylindrical axial extension thereof telescopically engaged with one end of said shaft and having said inlet passage of said dynamic impeller formed as an axial opening in said axial extension for fluid communication with the axial opening in said shaft.

5. A unified fuel pump assembly in accordance with claim 2, wherein:

said assembly further includes a liquid ring pump subassembly coupled to said shaft for rotation therewith in axially spaced apart relationship to said vane pump subassembly and said booster pump subassembly.

6. A unified fuel pump assembly in accordance with claim 5, wherein:

said liquid ring pump subassembly is positioned proximate one end of said shaft for rotation therewith, and said dynamic impeller of said booster pump is coupled to the other end of said shaft.

7. A unified fuel pump assembly in accordance with claim 5, wherein:

said housing further includes a support member having a longitudinal opening therethrough in axial fluid communication with said axial opening in said shaft, and at least one of said rotary bearings is coupled between and substantially coaxial with said support member and said shaft.

8. A unified fuel pump assembly in accordance with claim 2, wherein:

said assembly further includes an electric motor subassembly for imparting rotary motive power to said shaft, said electric motor subassembly having a rotor element coupled to said shaft and a stator element coupled to said housing.

9. A unified fuel pump assembly in accordance with claim 8, wherein:

said fuel pump assembly further includes a liquid ring pump subassembly having a plurality of paddle elements coupled to the rotor element of said electric motor subassembly, for rotation therewith.

* * * * *